US006996956B2

(12) United States Patent
Sperry et al.

(10) Patent No.: US 6,996,956 B2
(45) Date of Patent: Feb. 14, 2006

(54) FLUID DISPENSER HAVING IMPROVED CLEANING SOLVENT DELIVERY SYSTEM

(75) Inventors: Charles R. Sperry, Northampton, MA (US); Neil E. Rice, Jr., Charlestown, NH (US); Suzanne Scott, Springfield, VT (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 334 days.

(21) Appl. No.: 09/760,189

(22) Filed: Jan. 12, 2001

(65) Prior Publication Data

US 2002/0092278 A1 Jul. 18, 2002

(51) Int. Cl.
*B65B 9/02* (2006.01)

(52) U.S. Cl. ..... 53/553; 141/90; 222/148; 239/106; 239/112

(58) Field of Classification Search ..... 53/472, 53/554; 239/106, 108, 110, 112, 113, 115–118; 141/10, 90, 91, 85, 89, 114, 313–317, 311, 141/166; 222/145, 148, 190, 149, 152
See application file for complete search history.

(56) References Cited

U.S. PATENT DOCUMENTS

| | | | | |
|---|---|---|---|---|
| 3,687,370 A | | 8/1972 | Sperry | 239/112 |
| 3,926,229 A | | 12/1975 | Scholle | 141/1 |
| 3,945,569 A | | 3/1976 | Sperry | 239/112 |
| 4,273,263 A | | 6/1981 | Voegele et al. | 222/148 |
| 4,375,275 A | * | 3/1983 | Argazzi | 239/117 |
| 4,426,023 A | | 1/1984 | Sperry et al. | 222/132 |
| 4,674,268 A | | 6/1987 | Gavronsky et al. | 53/468 |
| 4,800,708 A | | 1/1989 | Sperry | 53/449 |
| 4,854,109 A | | 8/1989 | Pinarer et al. | 53/397 |
| 4,898,327 A | | 2/1990 | Sperry et al. | 239/1 |
| 5,027,583 A | | 7/1991 | Chelak | 53/451 |
| 5,040,728 A | * | 8/1991 | Zwirlein et al. | 239/116 |
| 5,129,580 A | * | 7/1992 | Schmitter | 239/118 |
| 5,225,847 A | * | 7/1993 | Roberts et al. | 343/745 |
| 5,255,847 A | * | 10/1993 | Sperry et al. | 239/112 |
| 5,335,483 A | | 8/1994 | Gavronsky et al. | 53/451 |
| 5,376,219 A | | 12/1994 | Sperry et al. | 156/515 |
| 5,727,370 A | | 3/1998 | Sperry | 53/472 |
| 5,776,510 A | | 7/1998 | Reichental et al. | 425/112 |
| 5,964,378 A | | 10/1999 | Sperry et al. | 221/145.2 |
| 5,996,848 A | * | 12/1999 | Sperry et al. | 222/145.2 |
| 6,003,288 A | | 12/1999 | Sperry et al. | 53/552 |
| 6,148,874 A | | 11/2000 | Rutter et al. | 141/10 |
| 6,283,174 B1 | * | 9/2001 | Sperry et al. | 141/114 |

* cited by examiner

*Primary Examiner*—Louis K. Huynh
*Assistant Examiner*—Thanh Truong
(74) *Attorney, Agent, or Firm*—Thomas C. Lagaly

(57) ABSTRACT

A fluid dispenser generally includes a housing and a valving rod disposed in and movable within the housing, the valving rod including a central bore, at least one inlet for receiving a cleaning solvent, and one or more outlet ports in fluid communication with the bore, wherein the outlet ports are capable of directing cleaning solvent radially outwards from the bore and against an interior surface of the dispenser to facilitate the removal of at least a portion of any fluid product or derivatives thereof that may be in adherence with such interior surface.

18 Claims, 14 Drawing Sheets

FLUID DISPENSER HAVING IMPROVED CLEANING SOLVENT DELIVERY SYSTEM

BACKGROUND OF THE INVENTION

The present invention pertains generally to fluid dispensers and related apparatus used to produce on-demand foam-in-place packaging cushions and, more particularly, to an improved system for delivering cleaning solvent to certain portions of such fluid dispensers that are particularly susceptible to occlusion due to build-up and/or hardening of fluid within the dispenser.

The invention finds particularly utility in the field of foam-in-place packaging, which is a highly useful technique for on-demand protection of packaged objects. In its most basic form, foam-in-place packaging comprises injecting foamable compositions from a dispenser into a container that holds an object to be cushioned. Typically, the object is wrapped in plastic to keep it from direct contact with the rising (expanding) foam. As the foam rises, it expands into the remaining space between the object and its container (e.g. a corrugated board box) thus forming a custom cushion for the object.

A common foamable composition is formed by mixing an isocyanate compound with a hydroxyl-containing material, such as a polyol (i.e., a compound that contains multiple hydroxyl groups), typically in the presence of water and a catalyst. The isocyanate and polyol precursors react to form polyurethane. At the same time, the water reacts with the isocyanate compound to produce carbon dioxide. The carbon dioxide causes the polyurethane to expand into a foamed cellular structure, i.e., a polyurethane foam, which serves to protect the packaged object.

In other types of foam-in-place packaging, an automated device produces flexible containers, e.g., in the form of bags, from flexible, plastic film and dispenses a foamable composition into the containers as the containers are being formed. As the composition expands into a foam within the container, the container is sealed shut and typically dropped into a box or carton holding the object to be cushioned. The rising foam again tends to expand into the available space, but does so inside the container. Because the containers are formed of flexible plastic, they form individual custom foam cushions around the packaged objects. Exemplary devices for automatically producing foam-in-place cushions in this manner are assigned to the assignee of the present invention, and are illustrated, for example, in U.S. Pat. Nos. 4,800,708, 4,854,109, 5,376,219, and 6,003,288, the contents of each of which are incorporated entirely herein by reference.

One difficulty with the foamable compositions used to make polyurethane foam for foam-in-place packaging is that the foam precursors and resultant foam tend to have somewhat adhesive properties. As a result, the foamable composition tends to stick to objects and then harden thereon into foam. This tendency is particularly problematic inside of the dispenser from which the foam precursors are ejected. As is known, the polyol and isocyanate foam precursors must be withheld from mixing with one another until just prior to injection. In the most common type of dispenser, the two foam precursors enter the dispenser, mix with one another in an internal chamber disposed within the dispenser to form a foamable composition, and then the resultant foamable composition exits the dispenser via a discharge port. As the dispenser operates over and over again, particularly in automated or successive fashion, foamable composition tends to build up in the internal mixing chamber and around the discharge port of the dispenser, harden into foam, and block the proper exiting of further foamable composition. As a result, the mixing chamber and discharge port must be frequently cleaned to ensure continued operation of the dispenser.

Further, such dispensers generally employ a valving rod that translates longitudinally within the mixing chamber to control the flow of the foam precursors therethrough, i.e., between an 'open' position, in which the precursors flow into and through the mixing chamber, and a 'closed' position, in which the precursors are prevented from flowing. Such valving rod is in contact with the foam precursors and resultant foamable composition, and thus must also be continually cleaned in order to prevent the build-up of foam thereon, which would otherwise impede and eventually prevent the further movement of the valving rod within the dispenser.

A solvent capable of dissolving both the foam precursors and the foamable composition is typically used to clean the dispensers. In order to clean the dispenser on an on-going basis without the necessity of frequent removal of the dispenser from the cushion-making device for manual cleaning and/or disassembly, solvent is generally contained in a reservoir located behind the mixing chamber and/or supplied to the discharge end of the dispenser from a separate source. Part of the valving rod moves through the reservoir as it translates between open and closed positions to partially clean the valving rod. However, the foam precursors and reaction products thereof gradually contaminate the solvent in the reservoir as they are transferred thereto from the valving rod. This requires periodic removal of the dispenser to either replace it with a dispenser having fresh solvent or to disassemble the cartridge for cleaning and replacement of the solvent. Further, while previous techniques for supplying solvent to the discharge end of the dispenser have been somewhat effective, none has been able to deliver solvent directly against the internal surfaces of the mixing chamber and discharge port.

As a result of the foregoing shortcomings, the effective service life of conventional dispensers has been much shorter than would otherwise be desired. It would therefore be desirable to extend this service life to the greatest extent possible.

Accordingly, a need exists in the art for an improved means for continually and automatically cleaning dispensers used in foam-in-place packaging.

SUMMARY OF THE INVENTION

That need is met by the present invention, which, in one aspect, provides a fluid dispenser, comprising:

a. a housing defining an internal chamber bounded by an interior surface within the housing, the housing comprising:
   (1) an inlet for receiving a fluid product into the housing and being in fluid communication with the internal chamber, and
   (2) a discharge port through which fluid product may exit the housing, the discharge port being in fluid communication with the internal chamber; and b. a valving rod disposed in the housing and being movable within the internal chamber between an open position, in which fluid product may flow through the internal chamber and exit the housing via the discharge port, and a closed position, in which fluid product is substantially prevented from flowing through the internal chamber, the valving rod comprising:

(1) a central bore, (2) at least one inlet for receiving a cleaning solvent, the inlet being in fluid communication with the bore, and (3) one or more outlet ports in fluid communication with the bore, the outlet ports being capable of directing cleaning solvent radially outwards from the bore and against the interior surface bounding the internal chamber to facilitate the removal of at least a portion of any fluid product or derivatives thereof that may be in adherence with the interior surface.

By delivering solvent radially outwards from the central bore of the valving rod and against the interior surface of the dispenser, including the interior surface of the discharge port, the inventive dispenser provides an improved means for automatically cleaning those areas of the dispenser that are most prone to foam build-up and occlusion. In this manner, the effective service life of the dispenser is greatly extended.

Another aspect of the invention is an apparatus for dispensing fluid into flexible containers and enclosing the fluid within the containers, comprising:

a. a mechanism that conveys a web of film along a predetermined path of travel, the film web comprising two juxtaposed plies of plastic film that define a partially-formed flexible container;

b. a dispenser, as described immediately above, through which a fluid product may flow in predetermined amounts, the dispenser positioned adjacent the travel path of the film web such that the dispenser can dispense fluid product into the partially-formed flexible container; and c. one or more devices for sealing the plies of plastic film together to complete the partially-formed container, thereby enclosing the fluid product therein.

An alternative fluid dispenser in accordance with the present invention comprises:

a. a housing, comprising (1) an inlet for receiving a fluid product into the housing, (2) an internal chamber disposed within the housing and being in fluid communication with the inlet, and (3) a discharge port through which fluid product may exit the housing, the discharge port being in fluid communication with the internal chamber, and (4) an internal reservoir in which cleaning solvent may be contained, the reservoir being disposed within the housing and positioned adjacent the internal chamber;

b. a valving rod disposed in the housing and movable within the internal chamber and the internal reservoir between an open position, in which fluid product may flow through the internal chamber and exit the housing via the discharge port, and a closed position, in which fluid product is substantially prevented from flowing through the internal chamber; and c. a conduit providing fluid communication between the internal reservoir and the discharge port to deliver cleaning solvent to the discharge port, the conduit positioned externally of the internal chamber.

BRIEF DESCRIPTION OF THE DRAWINGS

FIG. 5 is similar to FIG. 4 but taken along lines 5—5 in FIG. 6; also, the valving rod is shown in the 'open' position (whereas FIG. 4 shows the valving rod in the closed position);

DETAILED DESCRIPTION OF THE INVENTION

Figure 1:
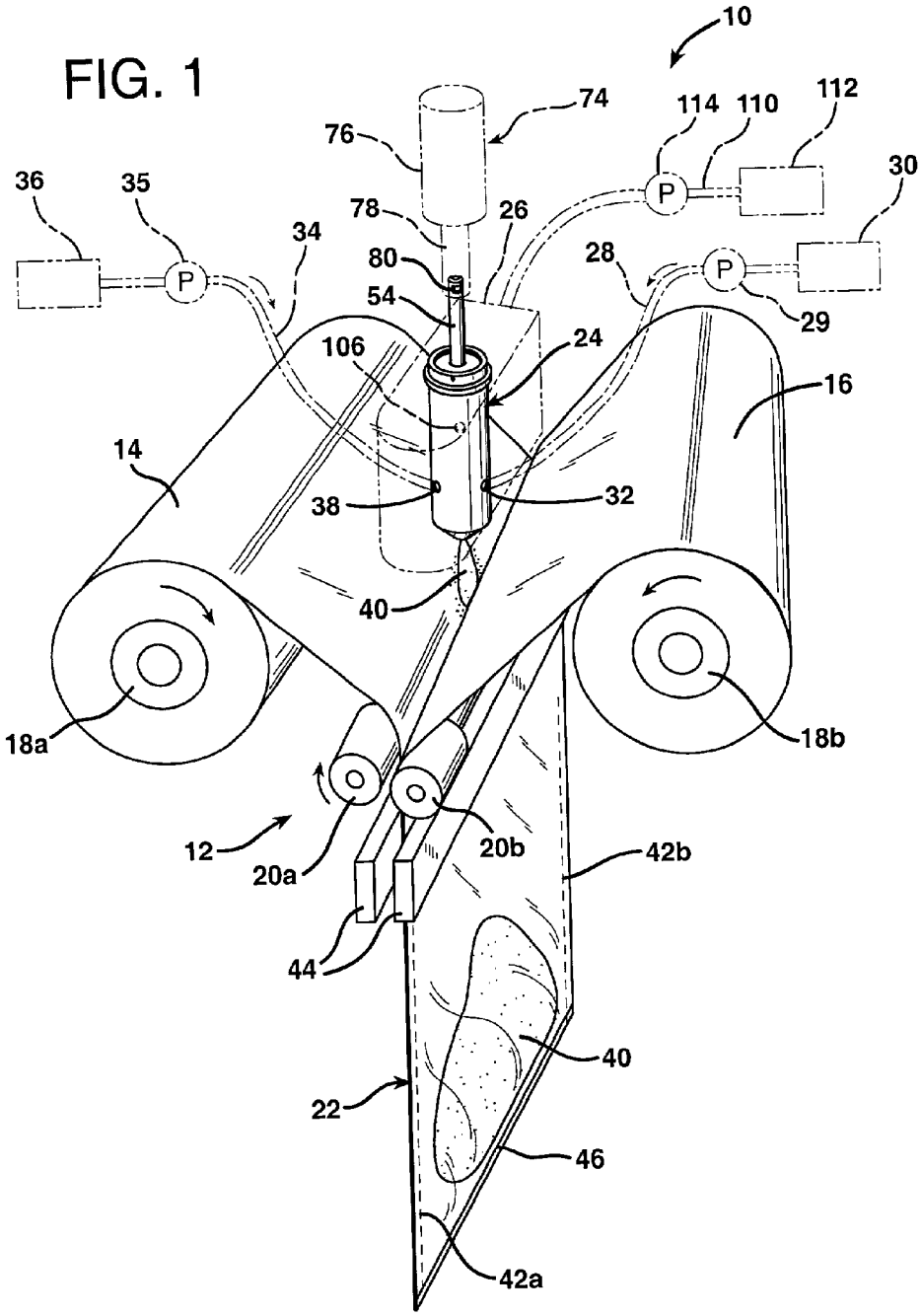
FIG. 1 is a perspective, schematic view of an apparatus and system in accordance with the present invention in which a dispenser introduces a foamable composition or other fluid product into a partially-formed flexible container as the container is being completed.

FIG. 1 shows an apparatus 10 in accordance with the present invention for dispensing fluid into flexible containers and enclosing the fluid within the containers. Apparatus 10 comprises a mechanism generally indicated at 12 that conveys a web of film, or in this case two webs of film 14 and 16, along a predetermined path of travel. Conveying mechanism 12 may include a pair of storage rollers 18*a* and 18*b* and a pair of nip rollers 20*a* and 20*b*. Film webs 14 and 16 are preferably supplied as wound rolls of film that may be supported on and unwound from respective storage rollers 18*a, b*. Nip rollers 20*a, b* rotate in opposing directions such that, when the films webs 14, 16 are passed therebetween, the rotation of the nip rollers cause the film webs to advance from storage rollers 18*a, b*. The nip rollers 20*a, b* are made to rotate in this manner by being mechanically or otherwise coupled to a suitable power source (not shown), e.g., an electric motor.

Film webs 14, 16 may comprise any flexible material that can be manipulated by apparatus 10, such as, e.g., various thermoplastic or fibrous materials such as polyethylene or paper. Preferably, film webs 14, 16 are flexible, thermoplastic films, and may be formed from any polymeric material capable of being formed into a foam-in-bag cushion as described herein. Non-limiting examples include polyethylene homopolymers, such as low density polyethylene (LDPE) and high density polyethylene (HDPE), and polyethylene copolymers such as, e.g., ionomers, EVA, EMA, heterogeneous (Zeigler-Natta catalyzed) ethylene/alpha-olefin copolymers, and homogeneous (metallocene, single-cite catalyzed) ethylene/alpha-olefin copolymers. Ethylene/alpha-olefin copolymers are copolymers of ethylene with one or more comonomers selected from $C_3$ to $C_{20}$ alpha-olefins, such as 1-butene, 1-pentene, 1-hexene, 1-octene, methyl pentene and the like, in which the polymer molecules comprise long chains with relatively few side chain branches, including linear low density polyethylene (LLDPE), linear medium density polyethylene (LMDPE), very low density polyethylene (VLDPE), and ultra-low density polyethylene (ULDPE). Various other materials are also suitable such as, e.g., polypropylene homopolymer or polypropylene copolymer (e.g., propylene/ethylene copolymer), polyesters, polystyrenes, polyamides, polycarbonates, etc. The film(s) may be monolayer or multilayer films and can be made by any known coextrusion process by melting the component polymer(s) and extruding or coextruding them through one or more flat or annular dies.

The "travel path" referred to herein is the route that each film web 14, 16 traverses while being conveyed through the apparatus 10. Conveying mechanism 12, and specifically nip rollers 20*a, b,* cause the film webs 14, 16 to converge as two juxtaposed plies of plastic film that define a partially-formed flexible container 22.

Apparatus 10 further includes a dispenser 24 through which a fluid product may flow in predetermined amounts. The dispenser 24 is positioned adjacent to (or partly in) the travel path of film webs 14, 16 such that it can dispense fluid product into the partially-formed flexible container 22. This may be accomplished by providing a manifold 26 (shown in phantom for clarity) or similar device to maintain dispenser 24 in a desired position relative to the travel path of film webs 14, 16. Manifold 26 may also be used to facilitate the connection to dispenser 24 of suitable piping, tubing, or other type of conduit to permit desired fluids to be transported to the dispenser. Many configurations are possible. As illustrated (again, in phantom for clarity), a conduit 28 from a first fluid source, shown schematically at 30, is connected to dispenser 24 via manifold 26 at first inlet 32. Similarly, a conduit 34 from a second fluid source, shown schematically at 36, is also connected to dispenser 24 via manifold 26 at second inlet 38. Respective pumps 29 and 35, or other suitable devices for causing fluid flow, may be used to facilitate the transfer of fluid from the first and second fluid sources 30 and 36, through the respective conduits 28 and 34, and into dispenser 24.

For foam-in-place packaging, dispenser 24 is preferably adapted to dispense a fluid product selected from polyols, isocyanates, and mixtures of polyols and isocyanates. Thus, first fluid source 30 may comprise a first fluid product comprising one or more polyols and the second fluid source 36 may comprise a second fluid product comprising one or more isocyanates. As will be explained in further detail below, dispenser 24 thereby mixes the polyols and isocyanates into a foamable composition, and dispenses the mixed fluid product/foamable composition 40 into the partially-formed flexible container 22. The amount of such foamable fluid to be dispensed into each container 22 by dispenser 24 is predetermined, based on, e.g., the internal volume within the container, the degree to which the fluid expands as it forms into a foam, the amount of foam that is desired to be contained in each completed container/packaging cushion, etc. Such determination of the predetermined amount of fluid to be dispensed by dispenser 24 is readily and commonly made by those having ordinary skill in the art to which this invention pertains, and requires no undue experimentation.

Apparatus 10 further includes one or more devices for sealing the plies of plastic film 14, 16 together to complete the partially-formed container 22, thereby enclosing the fluid product 40 therein. In addition to conveying the film webs 14, 16 through apparatus 10, nip rollers 20*a, b* may also serve a second function of producing longitudinal seals 42*a* and 42*b* on container 22. This may be accomplished via the application of sufficient heat by the nip rollers 20*a, b* to the two juxtaposed film plies 14, 16 to cause the longitudinal edges thereof to fuse together. Such a process is well known, e.g., as described in the above-incorporated patents. A preferred heat-sealing device is disclosed in a copending patent application entitled DEVICE FOR SEALING TWO PLIES OF FILM TOGETHER, PARTICULARLY FOR ENCLOSING A FOAMABLE COMPOSITION IN A FLEXIBLE CONTAINER (Sperry et al.), bearing Ser. No. 09/760,105 and filed on the same day as the present application, the disclosure of which is hereby incorporated herein by reference.

Alternatively, one or both of film webs 14, 16 may include strips of a bonding material at the longitudinal edges of the film webs, e.g., an adhesive or cohesive material, that form the longitudinal seals 42*a, b* when the films are pressed together by nip rolls 20*a, b*. This latter process is described in copending U.S. Ser. No. 09/591,830, filed Jun. 12, 2000 and entitled METHOD FOR ENCLOSING A FOAMABLE COMPOSITION IN A FLEXIBLE BAG (Oberle et al.), the disclosure of which is hereby incorporated herein by reference.

A severing and sealing mechanism 44 may also be provided to form transverse bottom and top seals 46 and 48, respectively, preferably by the application of sufficient heat and pressure to cause the films to fuse together across the entire width of the film webs. In a process that is also well described in the above-incorporated patents, transverse bottom seal 46 is first formed then, as the film webs 14, 16 are advanced by nip rollers 20*a, b* (and also longitudinal seals 42*a, b* formed thereby), dispenser 24 dispenses fluid product 40 into the partially-formed container 22 as the container is being formed. When a sufficient, predetermined amount of fluid product 40 has been added to the container and a sufficient amount (length) of the film webs 14, 16 have been withdrawn from storage rollers 18*a, b* to achieve a desired longitudinal length for container 16, severing and sealing mechanism 44 forms top transverse seal 48 (FIG. 2) to thereby seal the container closed and complete the partially-formed container 16, which becomes a completed flexible container 50, with fluid product 40 enclosed therein.

Figure 2:
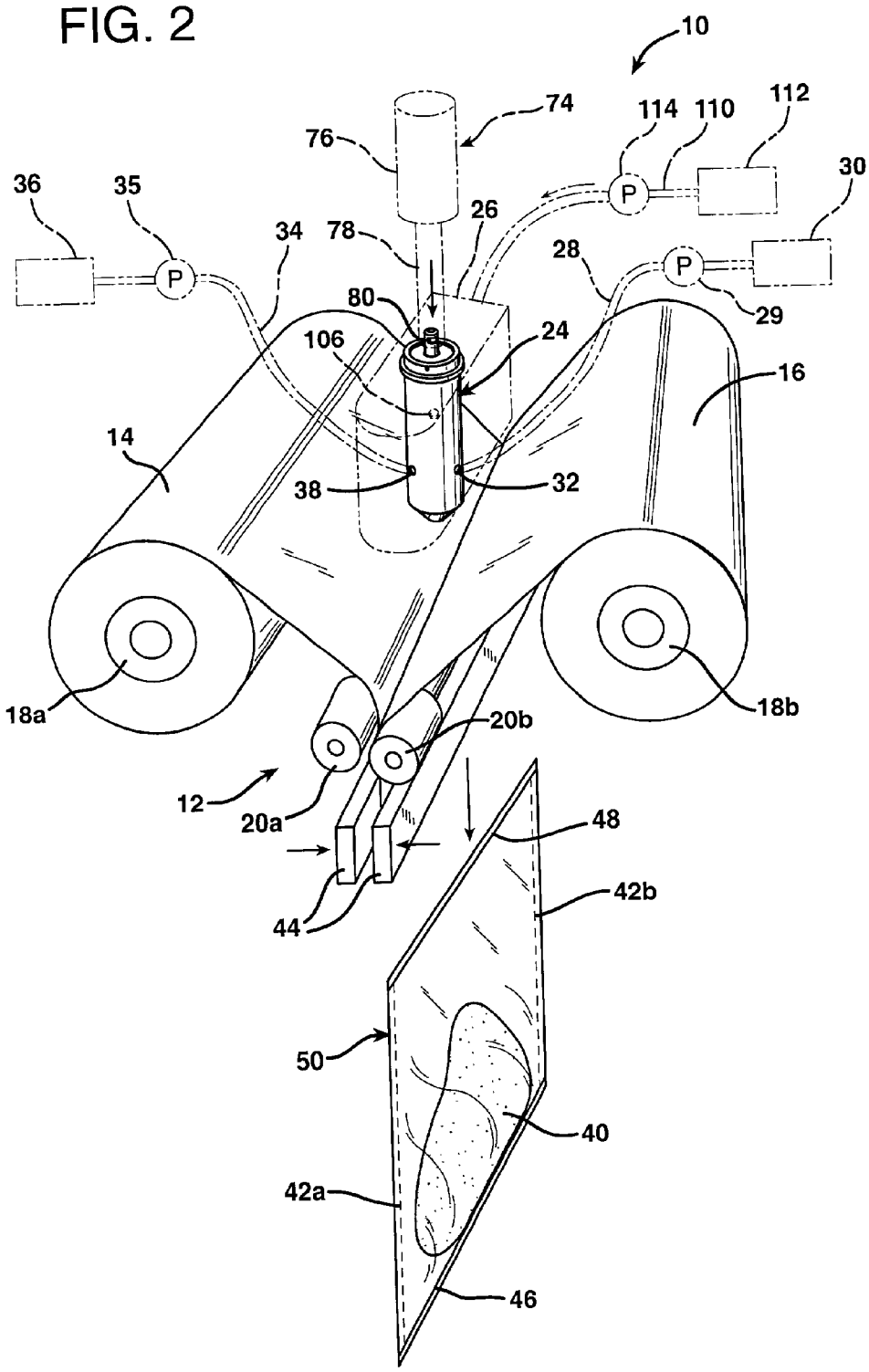
FIG. 2 is similar to FIG. 1, except that the container has been completed and severed from the film webs, thereby enclosing the foamable composition therein.
Figure 3:
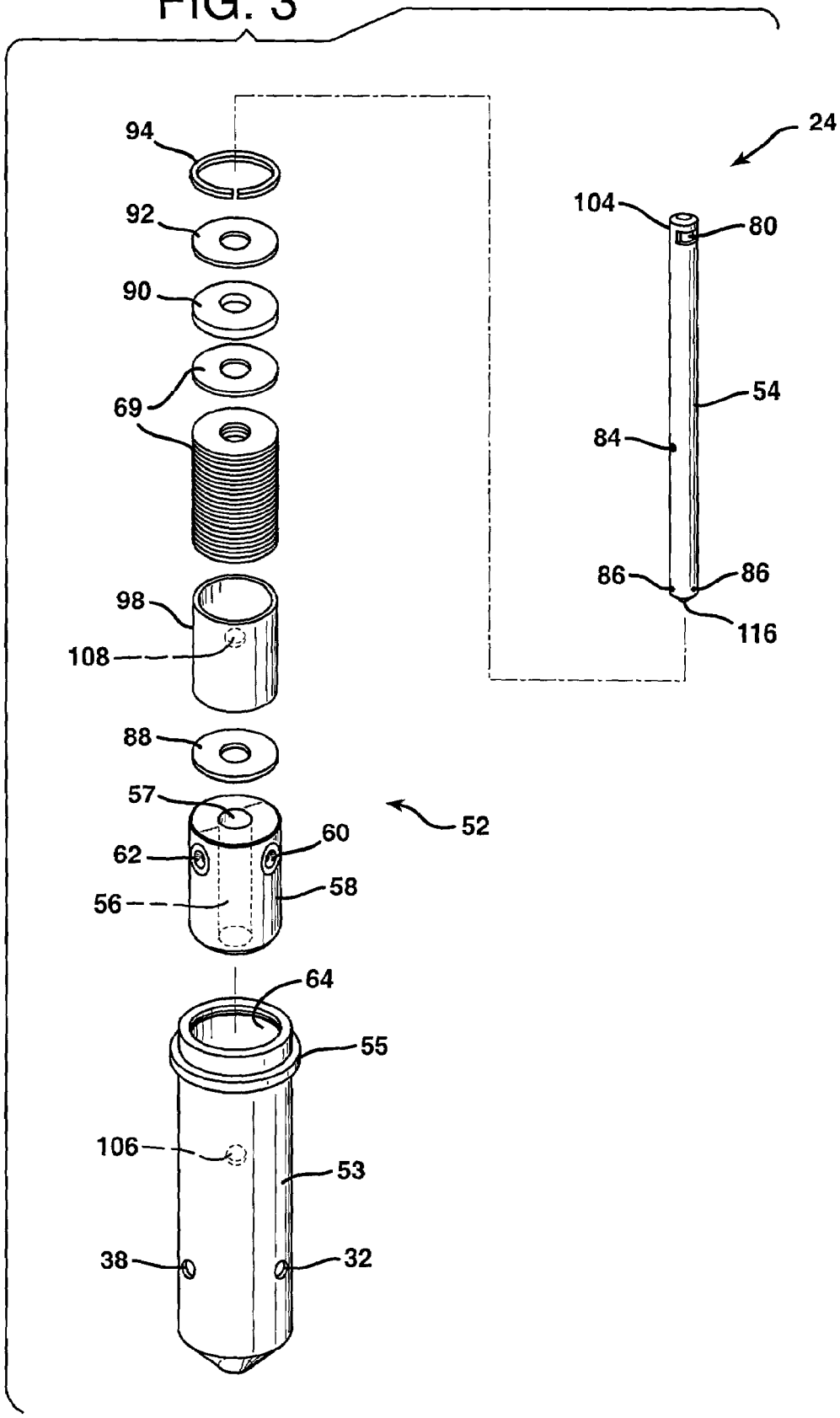
FIG. 3 is an exploded view of the dispenser shown in FIG. 1.

Simultaneous with or just after the formation of top transverse seal 48, severing/sealing mechanism 44 severs the completed container 50 from film webs 14, 16, preferably by applying sufficient heat to the film webs to melt completely through them such that the completed container 50 drops downwards by force of gravity from apparatus 10 as shown in FIG. 2. As clearly described in the above-referenced patents, the severing and sealing mechanism 44 may perform both functions, i.e., both the formation of transverse seals 46, 48 and the severing of completed container 50 from the film webs 14, 16, by including at least one wire (not shown) or other electrical resistance device on one or both halves of mechanism 44. Such wire or other device is heated sufficiently to melt through both of the juxtaposed films 14 and 16 when the wire is pressed into contact with the films, which can be done by causing both halves of the mechanism 44 to converge on the film and squeeze the films therebetween as indicated in FIG. 2. As such convergence occurs, a current may be sent through the wire, causing it to heat and melt through film webs 14, 16, thereby severing a completed container 50 from the film webs. At the same time, the heat from the wire causes the films to weld together both below and above the wire; the weld below the wire forms the transverse top seal 48 of the completed container 50 and the weld above the wire forms a transverse bottom seal as at 46 for the next container to be formed from film webs 14, 16.

Other techniques for forming transverse seals are possible, such as, e.g., employing two or more wires on one or both halves of the mechanism 44, with each wire performing a separate sealing or severing function. Exemplary foam-in-place packaging machines employing conveying, sealing, and severing mechanisms as described above are available from the assignee of this invention, Sealed Air Corporation of Saddle Brook, N.J., under the trademarks INSTA-PACKER™, VERSAPACKER™, and SPEEDY-PACKER™, among others.

Various alternatives to the apparatus 10 shown in FIGS. 1 and 2 may be employed to make flexible containers. For example, instead of using two separate webs of film to form containers as illustrated in the drawings, containers can be prepared from a center-folded film web, with the fold providing one of the longitudinal edges of the container. The dispenser is inserted into and positioned within the center-folded web via the opposite longitudinal edge, which is initially open before being sealed closed downstream of the dispenser, such as is described in the above-incorporated U.S. Pat. No. 6,003,288. A further alternative is to prepare the container from a tube of plastic film material and forming heat-seals only at the transverse top and bottom edges. An additional alternative is to employ a film web carrying a plurality of partially-formed containers, e.g., a series of partially-formed containers having one or more pre-formed heat-seals and which may be separable with pre-formed perforations. Such a film web and the method by which it is converted into foam-containing cushions are disclosed in a copending patent application entitled APPARATUS FOR DISPENSING FLUID INTO PRE-FORMED, FLEXIBLE CONTAINERS AND ENCLOSING THE FLUID WITHIN THE CONTAINERS (Sperry et al.), bearing Ser. No. 09/759,578 and filed on the same day as the present application, the disclosure of which is hereby incorporated herein by reference.

Regardless of the specific technique employed to form the containers, such containers may have any desired size and shape, and may be a bag, pouch, or other sealed enclosure of suitable dimensions for the intended packaging application.

Referring now to FIGS. 3–6, fluid dispenser 24 will be described in further detail. Fluid dispenser 24 comprises a housing 52 and a valving rod 54 disposed within the housing. Housing 52 preferably includes an outer housing unit 53, which may be constructed from stainless steel or other suitable material that is substantially inert and impervious with respect to the fluid product to be dispensed. The housing unit 53 may include a retaining flange 55 to allow dispenser 24 to be mounted in and retained by manifold 26. Alternatively, dispenser 24 and manifold 26 may be an integral unit.

Housing 52 defines an internal chamber 56 bounded by an interior surface 57 within such housing. Internal chamber 56 may be provided by mixing unit 58 as shown, as an integral or removable component of the housing 52.

Housing 52 additionally includes at least one inlet for receiving a fluid product into the housing, such inlet being in fluid communication with internal chamber 56. This may be accomplished by including in housing unit 53 a first inlet 32 and also second inlet 38 for receiving fluid product into housing 52, e.g., via respective conduits 28 and 34 as noted above. A greater or lesser number of fluid product inlets may be employed as desired. For instance, if a single fluid product or a pre-mixed fluid product is to be dispensed, i.e., as opposed to mixing two fluid product components in the dispenser as presently illustrated, only a single inlet into housing 52 is necessary.

Mixing unit 58, shown more fully in FIGS. 7–10, includes fluid passages 60, 62 that align with respective inlets 32, 38 so that such inlets may fluidly communicate with the internal chamber 56, i.e., by permitting the passage of fluid product from each inlet 32, 38 and into the internal chamber 56, wherein such fluids may mix together.

Figure 19:
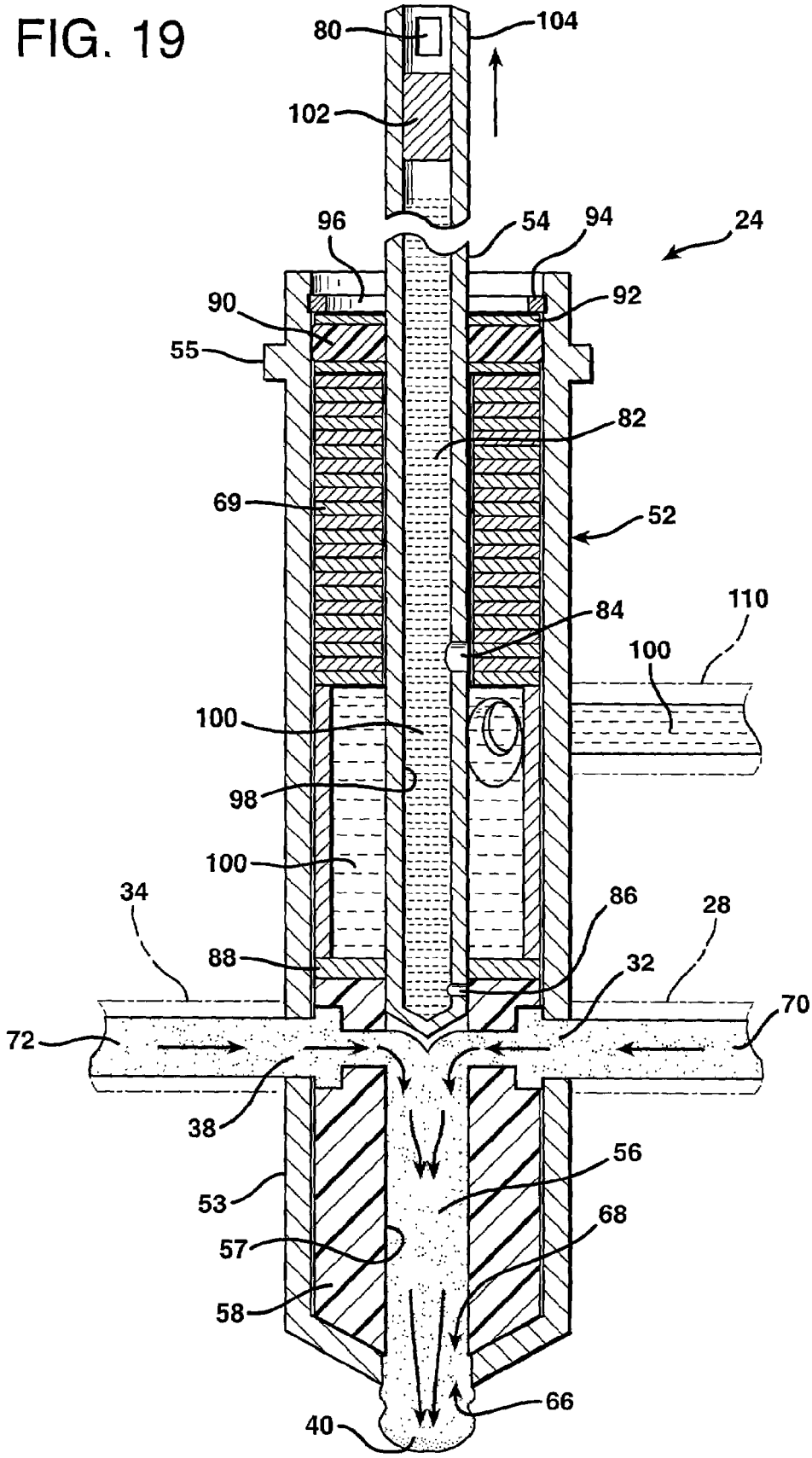
FIG. 19 is a cross-sectional, elevational view of the dispenser similar to the view shown in FIG. 5, showing the dispenser in operation with the valving rod retracted to an open position to allow the foam precursors to mix and flow out of the discharge port of the dispenser.

Preferably, valving rod 54 fits relatively tightly in mixing unit 58, i.e., the outside diameter of the valving rod is very close to, but only slightly larger than the inner diameter of internal chamber of mixing unit 58. For example, valving rod 54 may have an outside diameter of 0.187 inches while mixing unit 58 may have an inner diameter (i.e., the diameter of internal chamber 56 within mixing unit 58) of 0.189 inches, for a clearance of about 0.002 inch. A close fit between the valving rod and mixing unit is preferable in reducing the likelihood that fluid product(s) will leak from internal chamber 56 and into the other parts of housing 52 when such fluid products flow through the internal chamber (i.e., when the valving rod is in the 'open position' as shown in FIG. 19 (discussed below)).

Mixing unit 58 is preferably constructed from TEFLON (i.e., tetrafluoroethylene (TFE) or fluorinated ethylene-propylene (FEP) polymers) or any other suitable material that is substantially inert and impervious with respect to both the fluid product to be dispensed and the cleaning solvent used. It is to be understood, however, that a mixing unit as herein described is not critical to the invention, but is merely one means for providing an internal chamber through which fluid product flows and/or in which fluid product components can mix. For example, such internal chamber may instead be provided and defined by the interior surface 64 of the housing unit 53.

Housing 52 further includes a discharge port through which fluid product may exit housing 52, such discharge port being in fluid communication with internal chamber 56. As illustrated (FIGS. 7–12), this may be achieved by including in housing unit 53 a discharge port 66, which is aligned in housing 52 with a corresponding discharge port 68 of mixing unit 58. Discharge port 66 has an interior surface 59 that defines, i.e., bounds, part of the internal chamber 56 of housing 52. Interior surface 59 results from the wall thickness of housing unit 53. Thus, the internal chamber 56 is defined or bounded by both interior surface 57 (associated with mixing unit 58) and interior surface 59 (associated with discharge port 66 of housing unit 53).

Figure 20:
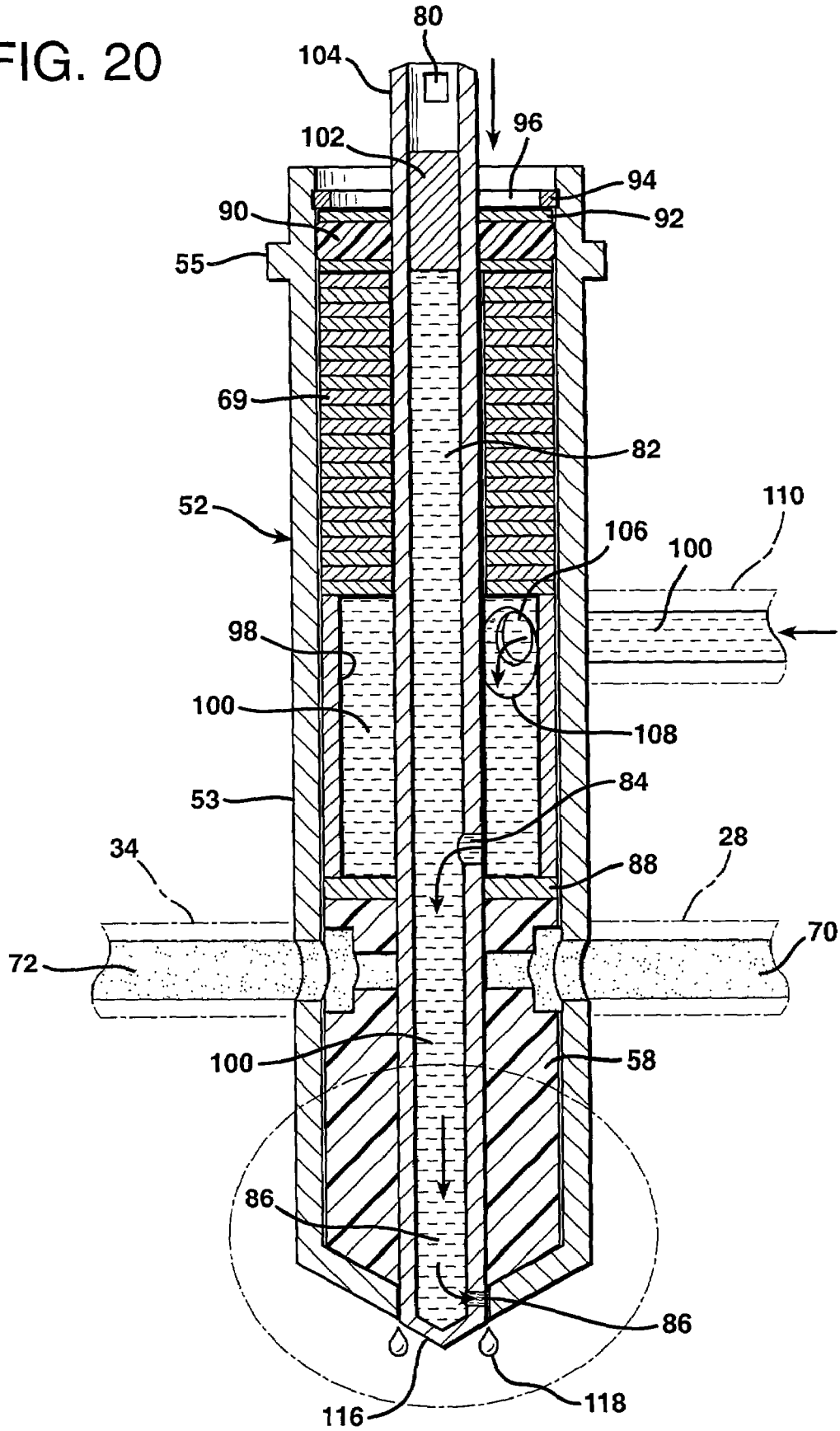
FIG. 20 is similar to FIG. 19, but shows the valving rod in the closed position to prevent the mixing and out-flow of the foam precursors, and also shows cleaning solvent being pumped through a central bore in the valving rod and flowing out of outlet ports at the distal end of the valving rod and against the internal surface of the mixing chamber.

Valving rod 54 is disposed in housing 52 and is movable within internal chamber 56 between:

an open position as shown in FIG. 19, in which fluid product may flow through the internal chamber and exit housing 52 via discharge ports 66, 68; and a closed position as shown in FIG. 20, in which fluid product is substantially prevented from flowing through internal chamber 56.

Figure 4:
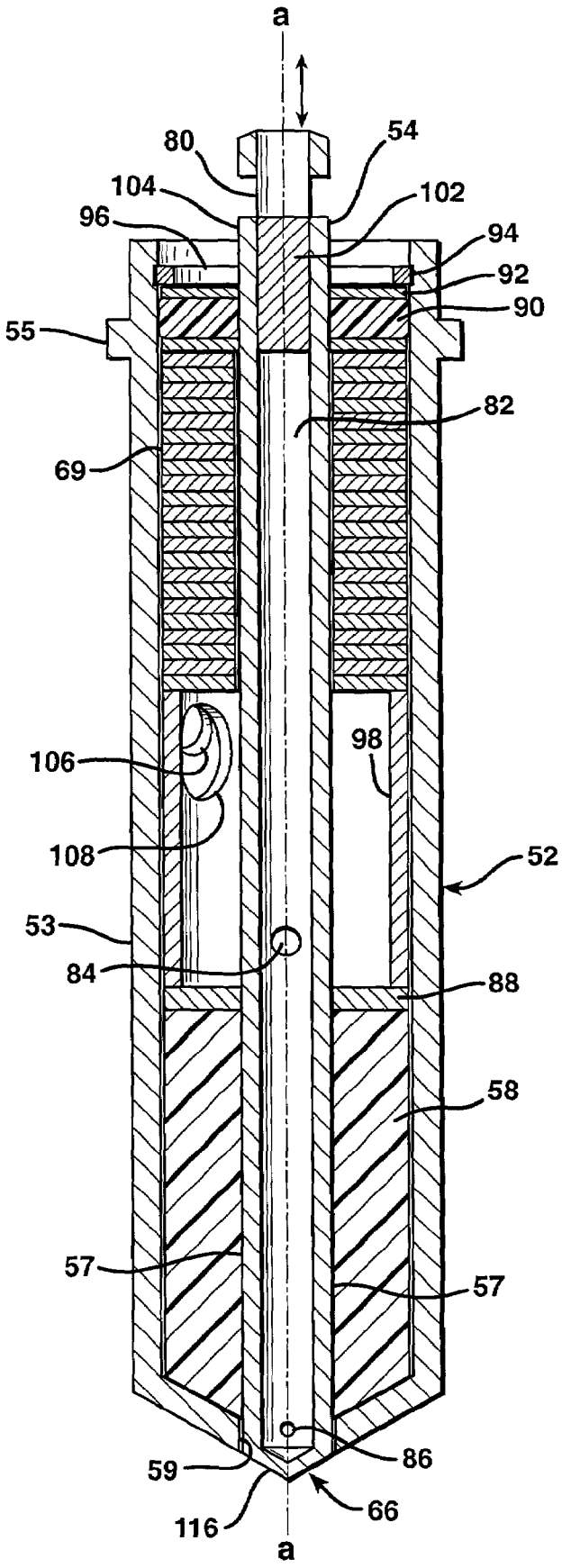
FIG. 4 is an elevational, cross-sectional view of a fully assembled dispenser as otherwise shown in FIG. 3, taken along lines 4—4 in FIG. 6.
Figure 5:
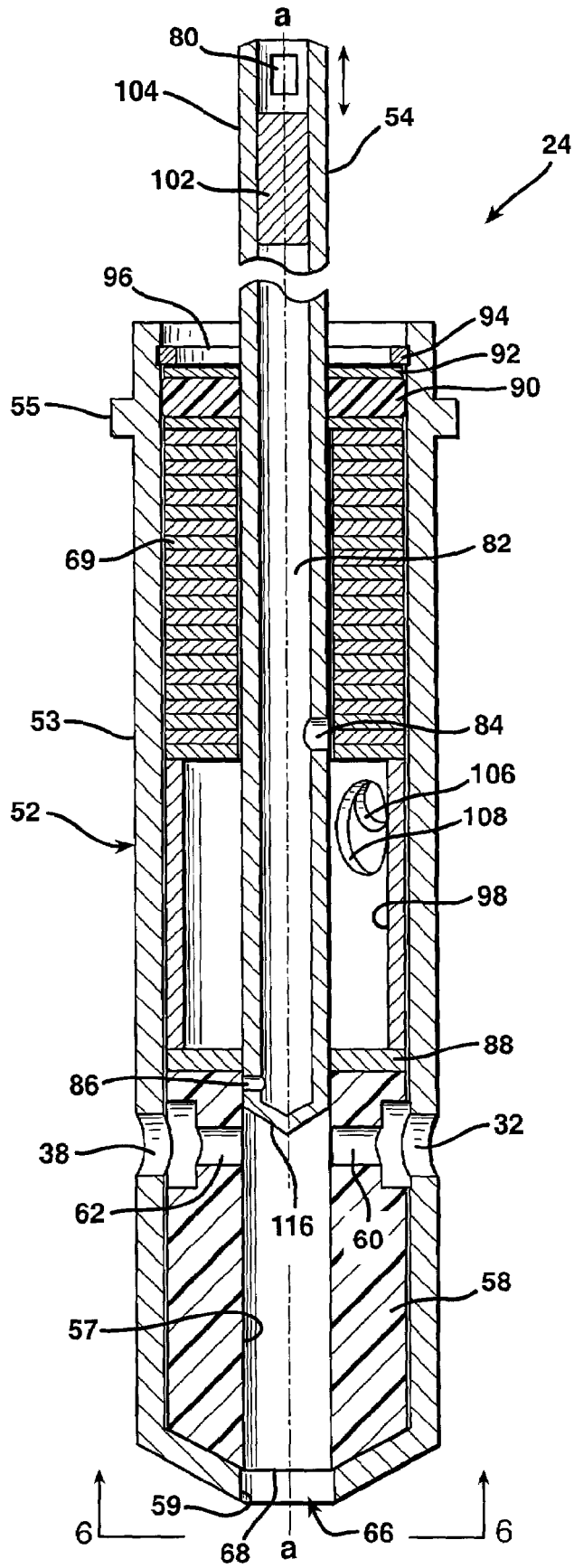

As indicated in FIGS. 4–5, housing 52 generally has a longitudinal axis "a—a," and valving rod 54 translates between such open and closed positions along the longitudinal axis a—a, as indicated by the two-way arrow. Guide rings 69, e.g., a stack of washers, may be provided in housing 52 to assist in maintaining valving rod 54 in proper alignment with the longitudinal axis a—a as it translates between open and closed positions. The guide washers 69 are preferably pressed into housing unit 53 such that they exert a compressive force on mixing unit 58. Such compression helps to prevent fluid product (from fluid passages 60 and/or 62) from leaking between the valving rod 54 and mixing unit 58 when the valving rod is in the closed position as shown in FIG. 20.

FIGS. 1 and 19 illustrate dispenser 24 with valving rod 54 in the open position. When the dispenser is used for foam-in-place packaging has described hereinabove, first inlet 32 may be placed in fluid communication with a first fluid product 70, comprising one or more polyols, by connecting conduit 28 (from first fluid source 30) to inlet 32. Similarly, second inlet 38 may be placed in fluid communication with a second fluid product 72, comprising one or more isocyanates, via conduit 34 (from second fluid source 36). In this manner, when valving rod 54 is in the open position as shown, the polyols and isocyanates mix together in internal chamber 56 to form a mixed fluid product/foamable composition 40, which then exits housing 52 via discharge ports 66, 68 and flows into the partially-formed flexible container 22.

Valving rod 54 may be moved between the open and closed positions thereof by any suitable mechanism, e.g., via an actuating mechanism 74 as shown in FIGS. 1–2, which includes an actuator 76 and drive arm 78. Actuator 76 may be powered electrically, pneumatically, or otherwise, and causes drive rod 78 to reciprocate both toward and away from dispenser 24. Drive rod 78 is, in turn, mechanically connected to valving rod 54 via slot 80. In this fashion, when drive rod 78 reciprocates away from dispenser 24, valving rod 54 assumes the open position shown in FIGS. 1 and 19 and, conversely, when the drive rod reciprocates toward the dispenser, the valving rod assumes the closed position shown in FIGS. 2 and 20.

As noted in the Background section above, as the dispenser operates over and over again, particularly in automated or successive fashion, the foamable composition 40 produced by mixing the first and second fluid products 70 and 72 has a tendency to build up in the internal chamber 56 and around the discharge port 66, harden into foam, and block the proper exiting of further foamable composition. The present invention provides an improved means for continually cleaning such interior surfaces to prevent such build-up, as will now be described.

Referring to FIGS. 4–5 and 13–15, valving rod 54 comprises a central bore 82; at least one inlet 84 for receiving a cleaning solvent, such inlet 84 being in fluid communication with bore 82; and one or more outlet ports 86 in fluid communication with bore 82. Central bore 82 of valving rod 54 is preferably in substantial alignment with the longitudinal axis a—a of housing 52 as shown.

Figure 21:
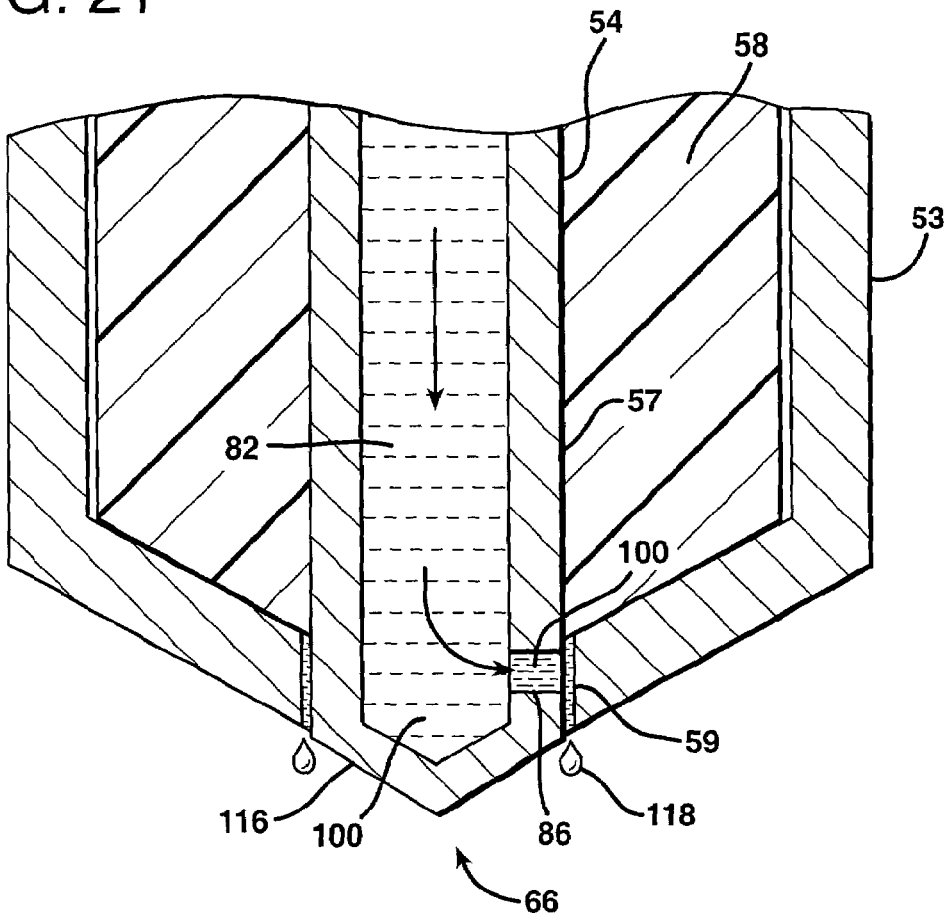
FIG. 21 is a close-up view of the circled portion of the dispenser shown in FIG. 20.

As shown perhaps most clearly in FIGS. 20–21, outlet ports 86 are capable of directing cleaning solvent radially outwards from bore 82 and against the interior surface 57 and/or interior surface 59 bounding internal chamber 56. This has been found to greatly facilitate the removal of at least a portion of any fluid product 70, 72, their mixture 40, or derivatives thereof that may be in adherence with the interior surfaces 57 and 59 of dispenser 24, and thereby prevents or at least significantly reduces the build-up of foam precursors and the foam produced thereby on the internal chamber 56 and discharge ports 66, 68. This, in turn, substantially increases the service life of the dispenser, i.e., the period of effective operation before manual cleaning or replacement becomes necessary.

Figure 6:
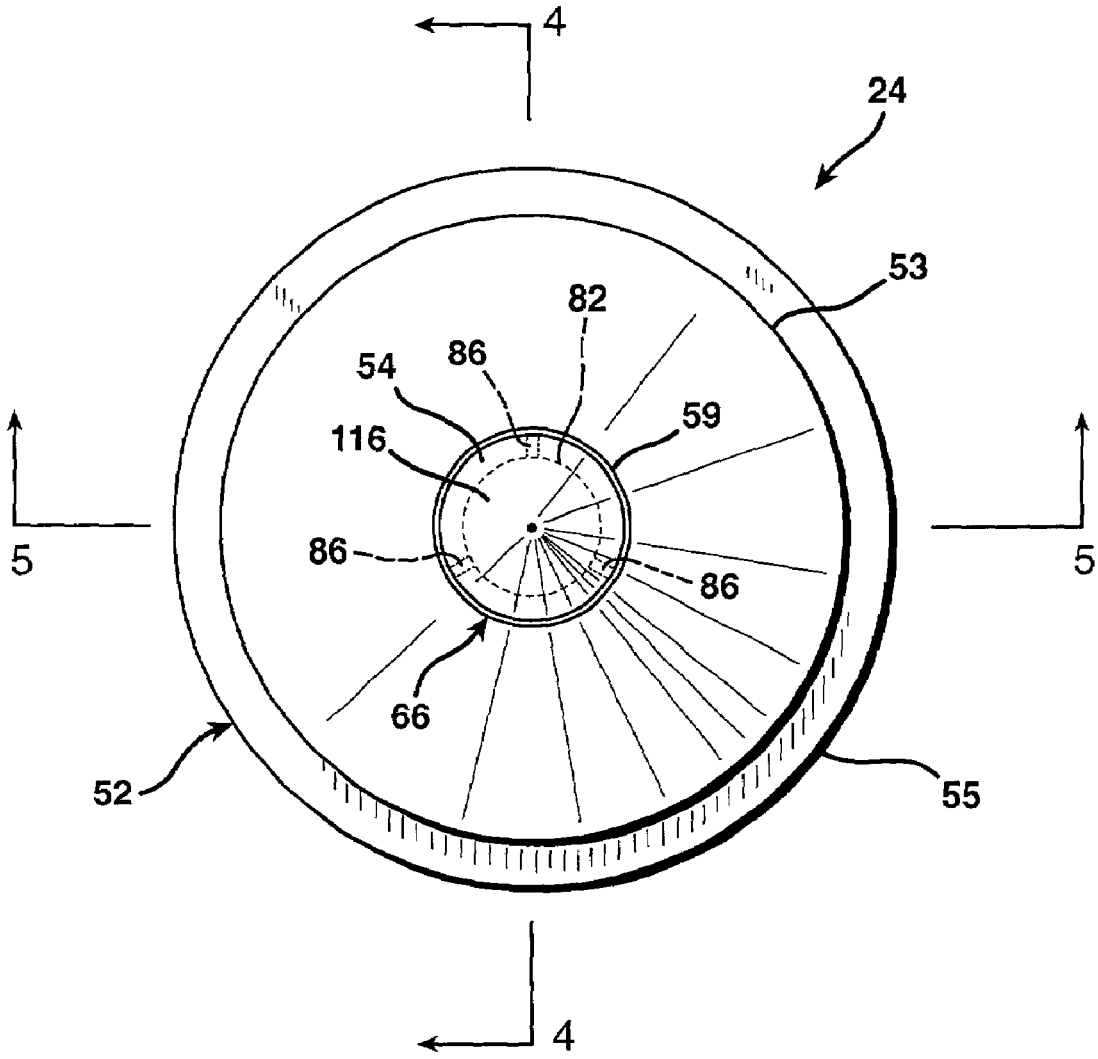
FIG. 6 shows the discharge end of the dispenser.
Figure 7:
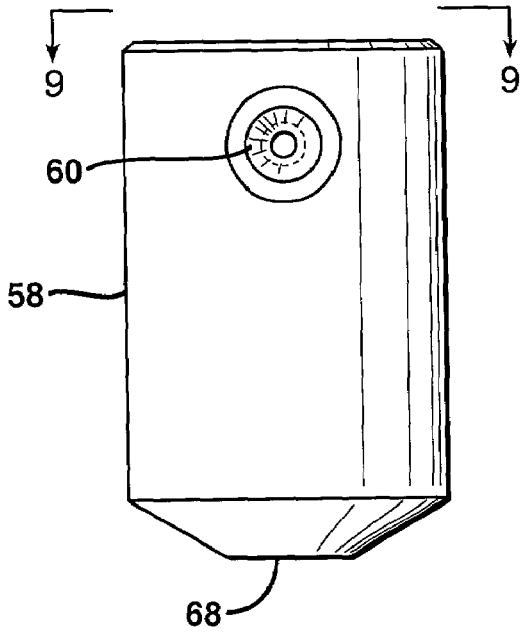
FIGS. 7–10 show various views of the mixing unit component of the dispenser as shown in FIG. 3.
Figure 8:
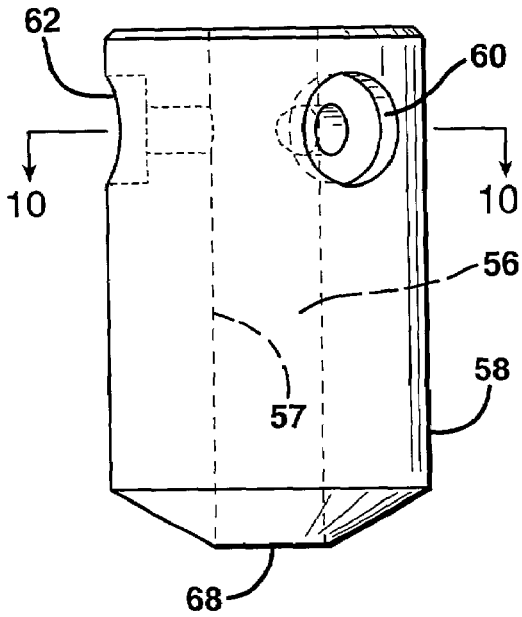
Figure 9:
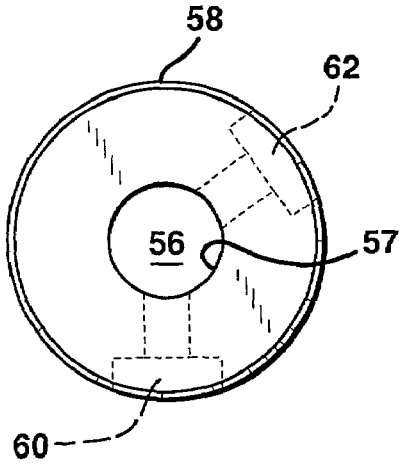
Figure 10:
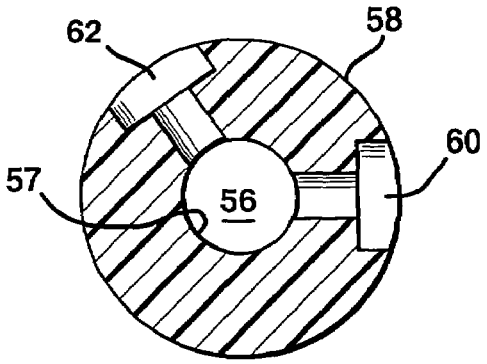

As perhaps best shown in FIG. 6, valving rod 54 preferably includes three outlet ports 86, evenly spaced about the circumference of the valving rod. This has been found to provide a sufficiently uniform distribution of cleaning solvent against the interior surfaces of the dispenser housing to effectuate the removal therefrom of fluid product and derivatives thereof. A greater or lesser number of outlet ports 86 may be included as desired, depending upon the intended application for dispenser 24.

In operation, a suitable cleaning solvent is introduced into the bore 82 of valving rod 54 via inlet 84. This may be accomplished in any suitable manner. As presently illustrated, the delivery of solvent into the central bore 82 is carried out as follows. Referring to FIGS. 3–5 and 20, housing 52 preferably comprises an internal reservoir in which cleaning solvent may be contained. Such reservoir may include substantially all of the available volume inside of housing 52 that extends from sealing ring 88 to sealing ring 90. Sealing rings 88, 90 may be included to enclose cleaning solvent within the housing, i.e., in the reservoir portion thereof. Thus, each ring preferably has an inner diameter that closely matches, but is slightly larger than, the outer diameter of valving rod 54. Ring 88 may also function to scrape fluid product and derivatives thereof from the outside of valving rod 54 as the valving rod moves past ring 88 and into the open position. As an alternative to a single ring, ring 90 may comprise a pair of concentric o-rings, with an inner ring in contact with valving rod 54 and the outer ring in contact with the interior surface 64 of housing unit 53.

Figure 16:
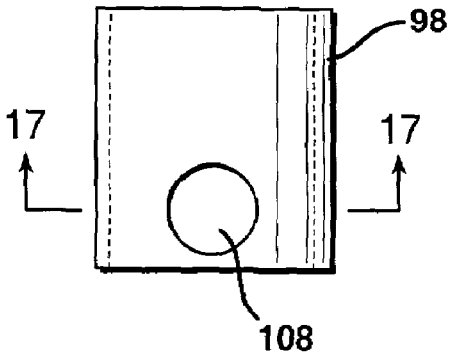
FIG. 16 is an elevational view of the spacer portion of the internal solvent reservoir in the dispenser as shown in FIG. 3.
Figure 17:
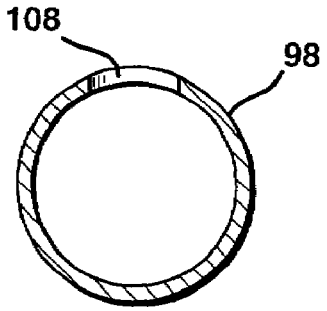
FIG. 17 is a cross-sectional view of the spacer taken along lines 17—17 in FIG. 16.
Figure 18:
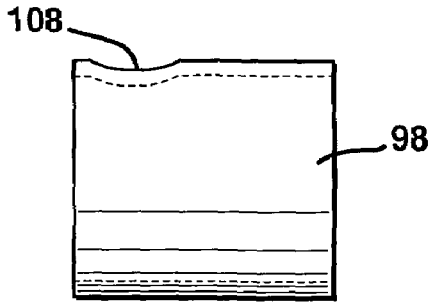
FIG. 18 is an elevational view of the spacer shown in FIG. 17.

The available solvent reservoir volume in housing 52 may be increased by including in the housing a spacer 98, e.g., between sealing ring 88 and guide rings 69 as shown (see also FIGS. 16–18).

Figure 11:
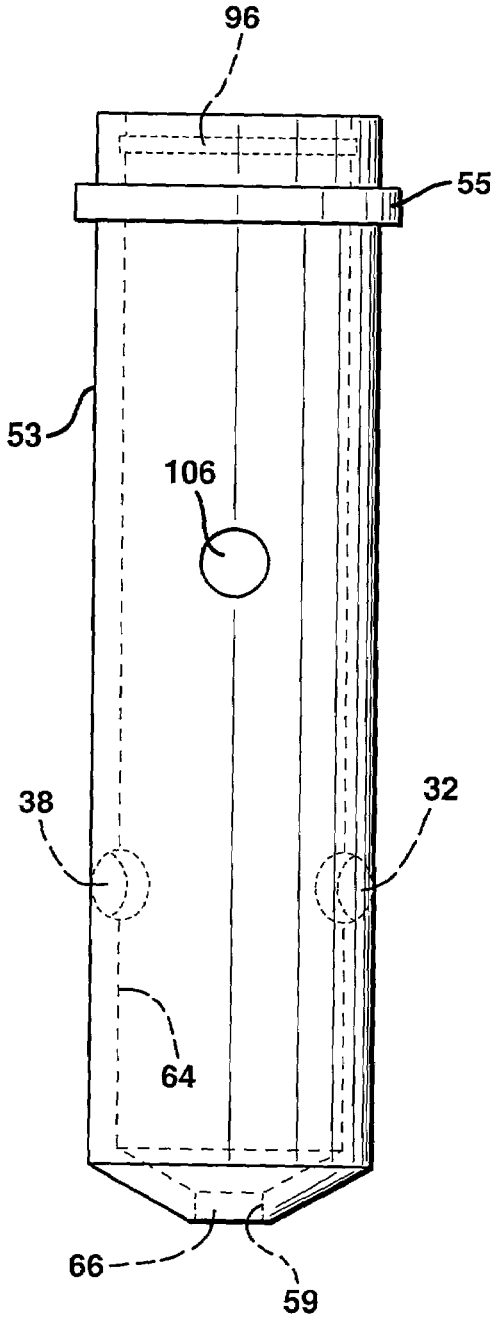
FIG. 11 is an elevational view of the housing component of the dispenser as shown in FIG. 3.
Figure 12:
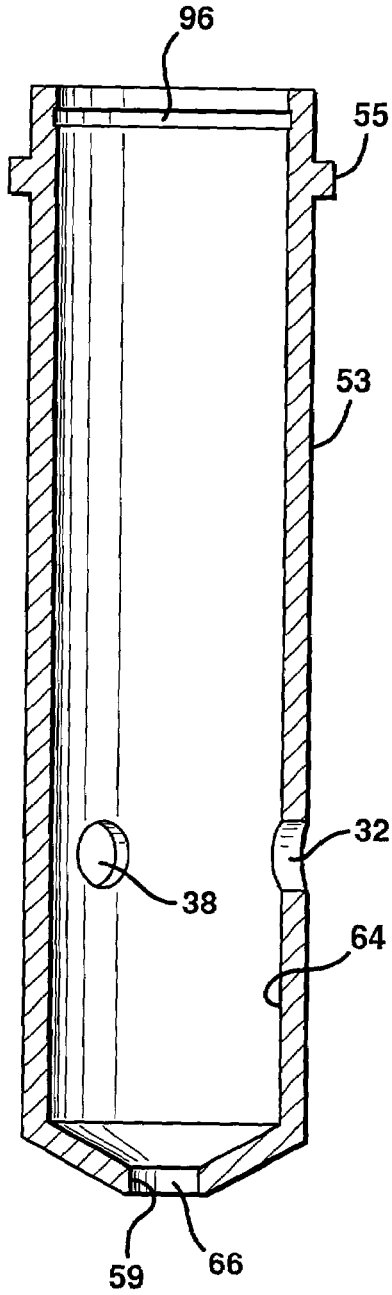
FIG. 12 is a cross-sectional view of the housing shown in FIG. 11.
Figure 13:
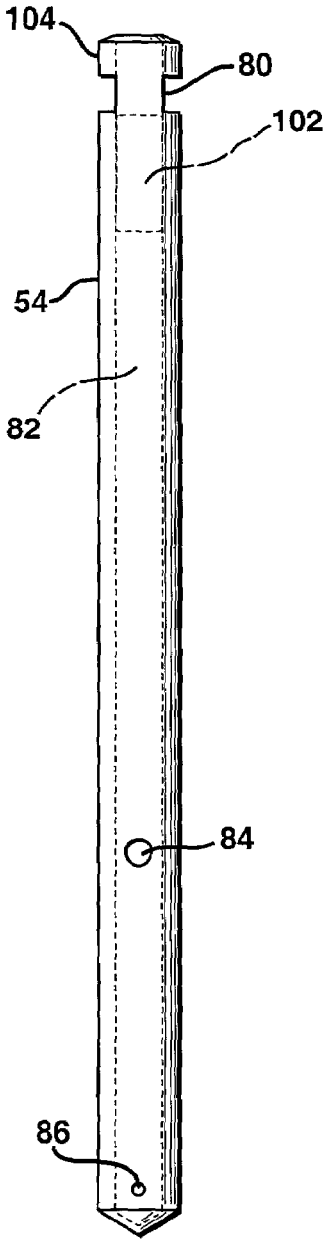
FIG. 13 is an elevational view of the valving rod component of the dispenser as shown in FIG. 3.
Figure 14:
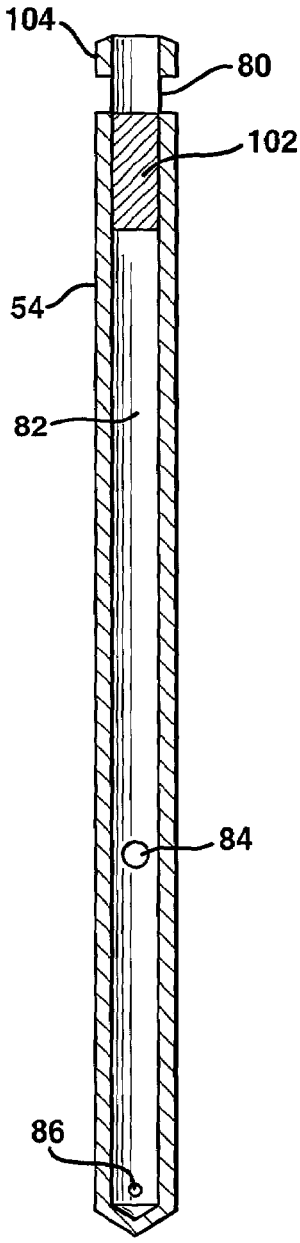
FIGS. 14–15 are cross-sectional views of the valving rod shown in FIG. 13, with one view being axially offset from the other by 90°.
Figure 15:
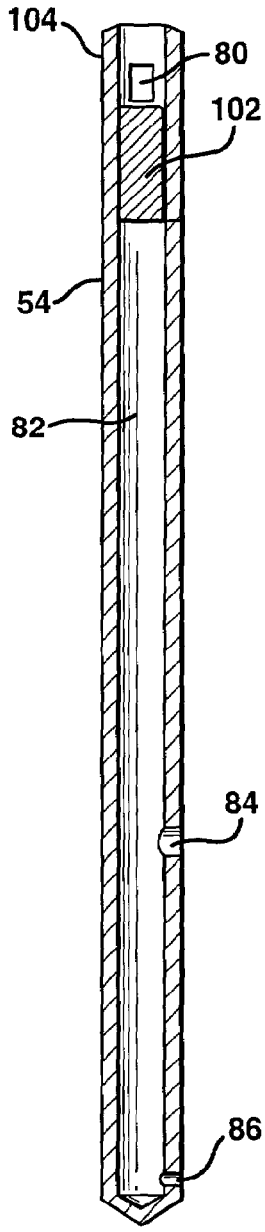

All of the internal components of housing 52 are held within housing unit 53 at a desired level of compression by retaining ring 92 and snap ring 94. Snap ring 94 may be an expandable, outwardly biased ring that is held in place against interior surface 64 of housing unit 53 by placing such ring 94 into groove 96 in housing unit 53 (FIGS. 11–12).

The internal reservoir contained in housing 52 between sealing rings 88, 90 is preferably in fluid communication with inlet 84 into said central bore 82 of valving rod 54. As shown in FIG. 20, such fluid communication may be achieved by placing inlet 84 of valving rod 54 inside of the internal reservoir defined by sealing rings 88, 90 in housing 52. In the embodiment shown, inlet 84 is positioned within spacer 98 when valving rod 54 is in the closed position. In this manner, when the internal reservoir is filled with cleaning solvent 100 as indicated in FIG. 20, the inlet 84 is immersed in solvent, and such solvent 100 can thereby enter central bore 82 of valving rod 54 for subsequent exit at outlet ports 86.

A plug 102 may be included in the bore 82 at the proximal end 104 of valving rod 54 as shown to prevent solvent 100 from flowing out of bore 82 at such proximal end (end 104 of the valving rod is termed "proximal" based on the positional relationship of such end with respect to actuating mechanism 74).

In a preferred embodiment of the invention, housing 52 includes at least one inlet in fluid communication with the internal reservoir in the housing so that cleaning solvent from an external source may be added to the reservoir as needed, i.e., to replace solvent as it is directed against the interior surfaces 57 and/or 59 of internal chamber 56. This may be accomplished by including in housing unit 53 a solvent inlet 106 and, aligned therewith, a corresponding inlet 108 in spacer 98. Further, a conduit 110 from an external solvent source, shown schematically at 112 in FIGS. 1 and 2, is connected to dispenser 24 via manifold 26 at solvent inlet 106. A pump 114, or other suitable mechanism for causing fluid flow, may be used to facilitate the transfer of cleaning solvent 100 from solvent source 112, through conduit 110, and into the solvent reservoir in housing 52 via aligned inlets 106, 108. In order for cleaning solvent 100 to exit valving rod 54 at outlet ports 86 and impinge upon the interior surfaces 57 and/or 59 at a desired velocity, pump 112 may apply a pressure ranging, e.g., from about 2 to about 12 psi to solvent 100 in the internal reservoir in housing 52 (i.e., as defined between sealing rings 88, 90).

In comparing FIGS. 19 and 20, it can be seen that when valving rod 54 is in the closed position as in FIG. 20, fluid products 70 and 72 are prevented from flowing through the internal chamber 56. However, while in such closed position, inlet 84 of the valving rod is in fluid communication with solvent 100 in the reservoir within housing 52 such that the solvent flows through the central bore 82 and exits the valving rod at outlet ports 86 to impinge against and thereby clean the interior surfaces of the internal chamber 56. As an example, when dispenser 24 is used to dispense a polyol/isocyanate mixture for foam-in-place packaging, between 0.1 and 1 ml of solvent 100 may be caused to flow out of outlet ports 86 while valving rod 54 is in the closed position as shown.

On the other hand, when the valving rod 54 is moved to the open position as in FIG. 19, the flow rate of solvent exiting the outlet ports 86 preferably decreases to a very low rate, e.g., just enough to provide a thin coating of solvent on the interior surface 57 as the valving rod moves into the open position. This may be accomplished in a number of ways. For example, pump 114 can be made to decrease or cease the application of pressure to solvent 100 in the internal reservoir in housing 52, e.g., by temporarily cutting off the supply of power to the pump via appropriate control means. Alternatively or in addition, valving rod 54 and mixing unit 58 may be constructed such that the valving rod fits tightly in internal chamber 56 within the mixing unit (as noted above). In this manner, solvent 100 is substantially blocked from flowing out of outlet ports 86 when the valving rod is in the open position as shown in FIG. 19. As a further alternative, inlet 84 may be positioned on valving rod 54 such that the inlet is no longer in the internal reservoir in housing 52 when the valving rod is in the open position, e.g., by placing the inlet 84 closer to the proximal end 104. Under such a construction, inlet 84 would no longer be in fluid communication with the internal reservoir when the valving rod is in the open position.

As noted above, while the valving rod 54 is being pulled into the open position by actuating mechanism 74, a relatively small quantity of solvent may be permitted to flow through outlet ports 86 so that the interior surface 57 of internal chamber 56 is coated with a film of solvent to dissolve or partially dissolve any fluid product or derivatives thereof that may have remained in adherence with such surface. In this manner, when the mixed fluid product 40 flows through the internal chamber 56, i.e., once the valving rod is moved fully into the open position, the formerly adhering/now dissolving fluid product or derivatives thereof are flushed out of the internal chamber. Fluid product build-up in the internal chamber is thereby prevented or at least substantially reduced.

Preferably, the outlet ports 86 of valving rod 54 are not aligned with inlet 32/fluid passage 60 or with inlet 38/fluid passage 62 in housing 52. This prevents fluid products 70 and/or 72 from potentially being injected into the outlet ports 86 of the valving rod when such outlet ports move past the fluid passages 60, 62 as the valving rod moves to its open and closed positions.

As an alternative to the foregoing configuration for supplying cleaning solvent to the central bore 82 of valving rod 54, a conduit from a source of cleaning solvent, such as conduit 110 from solvent source 112, may be connected directly to inlet 84 of the valving rod, with an internal reservoir either being omitted or segregated from the solvent that flows through the valving rod.

As shown perhaps most clearly in FIG. 21, a beneficial feature of the invention is that the outlet ports 86 of valving rod 54 are capable of directing cleaning solvent 100 radially outwards from central bore 82 and against the interior surfaces 57, 59 bounding the internal chamber 56. As used herein, the phrase "radially outwards" refers to the direction of solvent flow out of outlet ports 86, as may be determined, e.g., by the orientation and shape of the outlet ports, such direction being at an angle that is at least 10 degrees away from the direction of the longitudinal axis a—a of housing 52 and towards the surfaces 57, 59 of internal chamber 56 (see also FIG. 5). It has been determined that the efficacy of cleaning solvent 100 is substantially improved by directing such solvent radially outwards from the central bore of the valving rod and against the interior surface(s) of the internal chamber in housing 52. More preferably, the angle of solvent flow out of central bore 82 is at least 20 degrees away from the longitudinal axis a—a, such as, e.g., 30°, 40°, 50°, 60°, 70°, 75°, or 80° from axis a—a. For example, the angle of solvent flow may be substantially perpendicular (i.e., 90°) to longitudinal axis a—a as shown, i.e. by orienting outlet ports 86 in a substantially perpendicular configuration relative to axis a—a (and central bore 82).

The inventors hereof have also been determined that the most problematic part of dispenser 24 for foam build-up and occlusion is the discharge port 66 and, specifically, the interior surface 59 thereof, which also defines part of the internal mixing chamber 56. Thus, another beneficial feature of the present invention is that valving rod 54 is preferably adapted to direct cleaning solvent 100 against the interior surface 59 of discharge port 66 when the valving rod is in the closed position. As shown most clearly in FIG. 21, this may be accomplished by placing outlet ports 86 at the distal end 116 of valving rod 54 such that the outlet ports 86 are adjacent to the interior surface 59 when the valving rod is in the closed position. This configuration allows the solvent to flow directly against the problematic surface 59 and more effectively prevent foam build-up on such surface, as compared with previous dispensers.

In general, somewhat greater clearance is desired between the valving rod 54 and discharge port 66 than that between the valving rod and mixing unit 58 (as discussed above). Too tight a clearance would impede the flow of solvent out of outlet ports 86 and increase the incidence of 'jamming' between the distal end 116 of valving rod 54 and discharge port 66 as the valving rod cycles between the open and closed positions. On the other hand, too great a clearance may reduce the effectiveness of solvent impingement on and cleaning of the interior surface 59 of discharge port 66. For foam-in-place packaging, the clearance between the valving rod 54 and discharge port 66 preferably ranges from about 0.001 to about 0.010 inch.

As shown, the dissolved fluid product/solvent mixture 118 drips from the discharge port 66, i.e., from the space between the interior surface 59 of the discharge port and the distal end 116 of the valving rod 54, as a result of the flow of solvent against such interior surface. In this manner, the fluid product and derivatives thereof that would otherwise occlude the discharge port 66 is dissolved and drips into the next partially-formed container to be made into a foam-in-place cushion. The amount of such fluid product/solvent mixture is quite small in relation to the total amount of fluid product 40 that will be dispensed into such container, thus having no adverse effect on the expansion/foam formation of the foamable fluid product in the container.

While the distal end 116 of valving rod 54 is shown as pointed, this is not a critical feature of the invention and may have any desired shape, e.g., flat, concave, convex, curved, angular, etc.

A further feature of the invention is that a portion of valving rod 54 is movable through the internal reservoir defined in housing 52 between sealing rings 88, 90. This prevents fluid products and derivatives thereof from building up on the portion of the valving rod that moves through both the internal mixing chamber 58 and the reservoir; such build-up would otherwise prevent the movement of the valving rod through the housing 52. Advantageously, by continually directing a portion of the solvent contained in the reservoir through the valving rod 54 and replacing such solvent with fresh solvent from solvent source 112, the contaminating effects on the solvent contained in the reservoir, as caused by dissolved fluid product carried into the reservoir from the valving rod, are substantially reduced by continually flushing such contaminates out of the reservoir. The effective service life of the dispenser is thereby extended.

Any suitable cleaning solvent may be used in which the fluid products 70, 72, fluid product mixture 40, or derivatives thereof are at least partially soluble. "Derivatives" refers to any reaction-products (e.g., polyurethane), residue (e.g., by evaporation), or individual components of the fluid product or mixture of fluid products (where two or more fluid products are mixed in the dispenser). Where the dispenser 24 is used to produce foam-in-place packaging cushions, the solvent employed is preferably capable of at least partially dissolving both the polyol and isocyanate foam precursors, as well as the foamable composition and polyurethane foam reaction-products produced by their mixture. Suitable cleaning solvents for this purpose may be selected from glycols, ethers, and mixtures of glycols and ethers, e.g., a mixture of tripropylene glycol+methyl ether.

Figure 23:
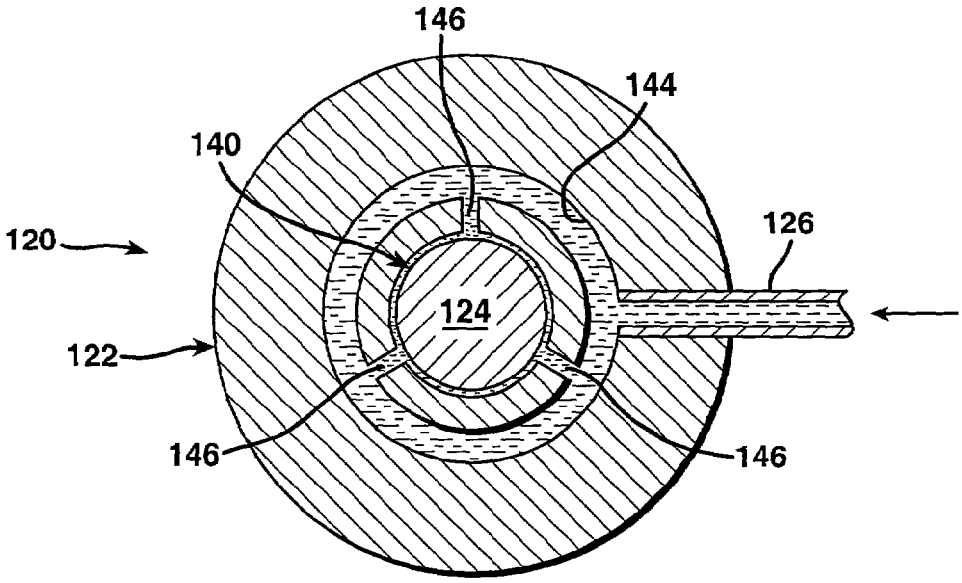
FIG. 23 is a view of the dispenser in FIG. 22 taken along lines 23—23.
Figure 22:
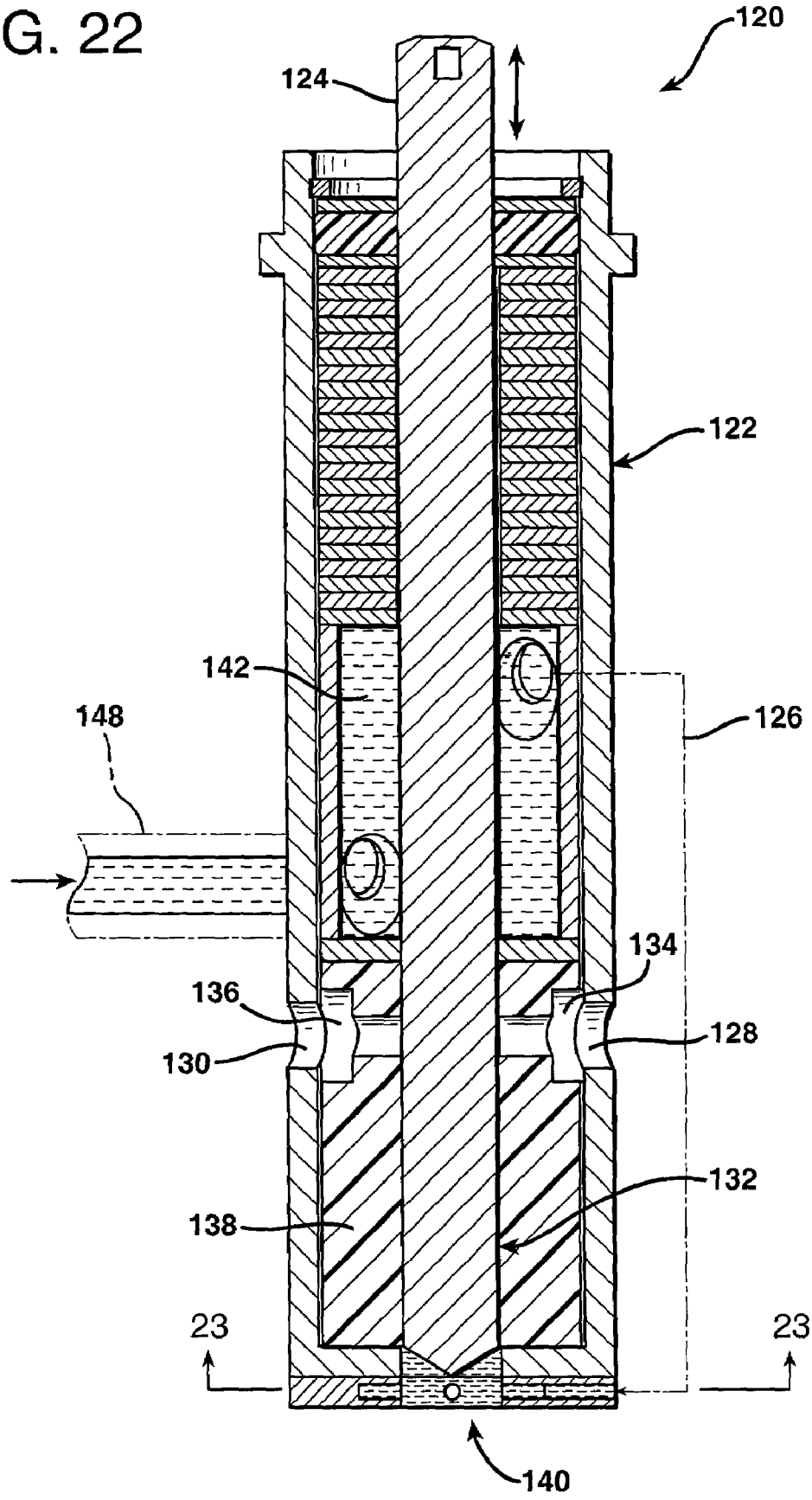
FIG. 22 is a cross-sectional, elevational view of an alternative dispenser in accordance with the present invention.

Referring now to FIGS. 22–23, and alternative fluid dispenser 120 in accordance with the present invention will be described. The primary difference between fluid dispenser 120 and dispenser 24 is that, while dispenser 24 delivers solvent to the internal chamber and discharge port via a central bore in the valving rod, dispenser 120 delivers solvent from an internal reservoir to the discharge port via an external conduit.

Dispenser 120 comprises a housing 122, a valving rod 124, and an external conduit, schematically represented at 126. Housing 122 comprises an inlet 128 for receiving a fluid product into the housing, and also a second inlet 130 for receiving fluid product. An internal chamber 132 (occupied by valving rod 124 in FIG. 22) is disposed within housing 122 and is in fluid communication with inlets 128 and 130 via respective fluid passages 134 and 136 in mixing unit 138. The mixing unit 138 defines the internal chamber 132. Housing 122 further includes a discharge port 140 through which fluid product may exit the housing, such discharge port being in fluid communication with internal chamber 132. Housing 122 also includes an internal reservoir 142 in which cleaning solvent may be contained, such reservoir being disposed within the housing and positioned adjacent to internal chamber 132.

Valving rod 124 is disposed in housing 122 and movable within the internal chamber 132 and internal reservoir 142 between an open position, in which fluid product may flow through the internal chamber and exit housing 122 via discharge port 140, and a closed position (as shown in FIG. 22), in which fluid product is substantially prevented from flowing through internal chamber 132.

The foregoing components of dispenser 120 operate in the same manner as their counterpart components in dispenser 24, as described above. Dispenser 120 differs from dispenser 24 in that dispenser 120 includes an external conduit 126, which is positioned externally of internal chamber 132. Conduit 126 provides fluid communication between internal solvent reservoir 142 and discharge port 140. In this manner, cleaning solvent as contained in the reservoir 142 may be delivered to discharge port 140. As shown, this may be accomplished by employing a distribution manifold 144 to receive solvent from the reservoir 142 via external conduit 126. The manifold 144, in turn, distributes the solvent about the discharge port 140 via solvent outlet ports 146.

Preferably, a mechanism such as pump 114 is employed to supply fresh cleaning solvent, e.g., from a solvent source such as source 30, to internal reservoir 142 from a supply conduit 148, and also apply pressure to such reservoir to facilitate the delivery of cleaning solvent from the reservoir to discharge port 140 via conduit 126. In this manner, the contaminating effects on the solvent contained in the reservoir 142, as caused by dissolved fluid product that may be carried into the reservoir from valving rod 124, are substantially reduced by continually flushing such contaminates out of the reservoir. The effective service life of the dispenser is thereby extended.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention.

What is claimed is:

1. A fluid dispenser, comprising:

a. a housing having an internal chamber, said housing comprising:

(1) an inlet for receiving a fluid product into said housing and being in fluid communication with said internal chamber, and (2) a discharge port through which fluid product may exit said housing, said discharge port having an interior surface and being in fluid communication with said internal chamber; and b. a valving rod disposed in said housing and being movable within said internal chamber between an open position, in which fluid product may flow through said internal chamber and exit said housing via said discharge port, and a closed position, in which fluid product is substantially prevented from flowing through said internal chamber, said valving rod comprising:

(1) a central bore, (2) at least one inlet for receiving a cleaning solvent, said inlet being in fluid communication with said bore, and (3) one or more outlet ports in fluid communication with said bore, said outlet ports being capable of directing cleaning solvent radially outwards from said or and against said interior surface of said discharge port when said valving rod is in said closed position to facilitate the removal of at least a portion of any fluid product or derivatives thereof that may be in adherence with said interior surface of said discharge port.

2. The fluid dispenser of claim 1, wherein said housing has a longitudinal axis;

said bore of said valving rod is substantially aligned with said longitudinal axis; and said valving rod translates between said open and closed positions along said longitudinal axis.

3. The fluid dispenser of claim 1, wherein said housing further comprises an internal reservoir in which cleaning solvent may be contained, said internal reservoir being in fluid communication with said at least one inlet into said central bore of said valving rod.

4. The fluid dispenser of claim 3, wherein at least a portion of said valving rod is movable through said internal reservoir.

5. The fluid dispenser of claim 3, wherein said housing has at least one inlet in fluid communication with said internal reservoir so that cleaning solvent from an external source may be added to said reservoir as needed.

6. The fluid dispenser of claim 5, further including a mechanism to apply a pressure ranging from about 2 to about 12 psi to said internal reservoir.

7. The fluid dispenser of claim 3, wherein said cleaning solvent is selected from glycols, ethers, and mixtures of glycols and ethers.

8. The fluid dispenser of claim 1, wherein said dispenser is adapted to dispense a fluid product selected from polyols, isocyanates, and mixtures of polyols and isocyanates.

9. An apparatus for dispensing fluid into flexible containers and enclosing the fluid within the containers, comprising:

a. a mechanism that conveys a web of film along a predetermined path of travel, said film web comprising two juxtaposed plies of plastic film that define a partially-formed flexible container;

b. a dispenser through which a fluid product may flow in predetermined amounts, said dispenser positioned adjacent the travel path of the film web such that said dispenser can dispense fluid product into the partially-formed flexible container, said dispenser comprising:

(1) a housing having an internal chamber, said housing comprising:

(a) an inlet for receiving a fluid product into said housing and being in fluid communication with said internal chamber, and (b) a discharge port through which fluid product may exit said housing, said discharge port having an interior surface and being in fluid communication with said internal chamber; and (2) a valving rod disposed in said housing and being movable within said internal chamber between an open position, in which fluid product may flow through said internal chamber and exit said housing via said discharge port, and a closed position, in which fluid product is substantially prevented from flowing through said internal chamber, said valving rod comprising (a) a central bore, (b) at least one inlet for receiving a cleaning solvent, said inlet being in fluid communication with said bore, and (c) one or more outlet ports in fluid communication with said bore, said outlet ports being capable of directing cleaning solvent radially outwards from said bore and against said interior surface of said discharge port when said valving rod is in said closed position to facilitate the removal of at least a portion of any fluid product or derivatives thereof that may be in adherence with said interior surface of said discharge port; and c. one or more devices for sealing the plies of plastic film together to complete the partially-formed container, thereby enclosing the fluid product therein.

10. The apparatus of claim 9, wherein said dispenser housing has a longitudinal axis;

said bore of said valving rod is substantially aligned with said longitudinal axis; and said valving rod translates between said open and closed positions along said longitudinal axis.

11. The apparatus of claim 9, wherein said dispenser housing further comprises an internal reservoir in which cleaning solvent may be contained, said internal reservoir being in fluid communication with said at least one inlet into said central bore of said valving rod.

12. The apparatus of claim 11, wherein at least a portion of said valving rod is movable through said internal reservoir.

13. The apparatus of claim 11, wherein said housing has at least one inlet in fluid communication with said internal reservoir so that cleaning solvent from an external source may be added to said reservoir as needed.

14. The apparatus of claim 13, further including a mechanism to apply a pressure ranging from about 2 to about 12 psi to said internal reservoir.

15. The apparatus of claim 11, wherein said cleaning solvent is selected from glycols, ethers, and mixtures of glycols and ethers.

16. The apparatus of claim 9, wherein said dispenser is adapted to dispense a fluid product selected from polyols, isocyanates, and mixtures of polyols and isocyanates.

17. The apparatus of claim 9, wherein:

said housing inlet in fluid communication with said internal chamber comprises a first inlet in fluid communication with a first fluid product comprising one or more polyols;

said housing comprises a second inlet in fluid communication with said internal chamber and with a second fluid product comprising one or more isocyanates; and when said valving rod is in said open position, the polyols and isocyanates are mixed in said internal chamber and dispensed into the partially-formed flexible container.

18. A fluid dispenser, comprising:

a. a housing, comprising (1) an inlet for receiving a fluid product into said housing, (2) an internal chamber disposed within said housing and being in fluid communication with said inlet, and (3) a discharge port through which fluid product may exit said housing, said discharge port being in fluid communication with said internal chamber, and (4) an internal reservoir in which cleaning solvent may be contained, said reservoir being disposed within said housing and positioned adjacent said internal chamber;

b. a valving rod disposed in said housing and movable within said internal chamber and said internal reservoir between an open position, in which fluid product may flow through said internal chamber and exit said housing via said discharge port, and a closed position, in which fluid product is substantially prevented from flowing through said internal chamber; and c. a conduit providing fluid communication between said internal reservoir and said discharge port to deliver cleaning solvent to said discharge port, said conduit positioned externally of said internal chamber.

* * * * *

UNITED STATES PATENT AND TRADEMARK OFFICE

CERTIFICATE OF CORRECTION

PATENT NO. : 6,996,956 B2
APPLICATION NO. : 09/760189
DATED : February 14, 2006
INVENTOR(S) : Sperry et al.

It is certified that error appears in the above-identified patent and that said Letters Patent is hereby corrected as shown below:

Column 15,
Line 20, "or" should be --bore--.

Signed and Sealed this

Fourth Day of July, 2006

JON W. DUDAS
*Director of the United States Patent and Trademark Office*